US005358279A

United States Patent [19]

Sweet

[11] Patent Number: 5,358,279

[45] Date of Patent: Oct. 25, 1994

[54] ELASTOMERIC BOOKMARK ASSEMBLY WITH STATIC ELECTRICITY AND ADHESIVE PORTIONS

[75] Inventor: Stephen Sweet, Keizer, Oreg.

[73] Assignee: Xertrex International, Inc., Itasca, Ill.

[21] Appl. No.: 178,851

[22] Filed: Dec. 23, 1993

Related U.S. Application Data

[63] Continuation of Ser. No. 959,608, Oct. 13, 1992, abandoned.

[51] Int. Cl.[5] ..... B42D 9/00

[52] U.S. Cl. ..... 281/42; 281/51; 116/237

[58] Field of Search ..... 281/38, 42, 51; 116/234, 237, 238, 239; D19/34

[56] References Cited

U.S. PATENT DOCUMENTS 2,591,094 4/1952 O'Neill ..... 281/42 X
3,324,823 6/1967 Peters ..... 281/42 X
3,697,100 10/1972 Hawkins ..... 281/42
4,574,727 3/1986 Martin, Jr. ..... 116/239 X
4,848,799 7/1989 Turetsky ..... 281/42

FOREIGN PATENT DOCUMENTS 585130 1/1947 United Kingdom ..... 281/42

*Primary Examiner*—Peter Dungba Vo
*Attorney, Agent, or Firm*—Gerald S. Geren

[57] ABSTRACT

There is disclosed herein a bookmark to be attached to the back of a book to separate read and unread pages and which carries indicia-receiving areas for receiving advertising or reader's notes. The bookmark is a thin elongated rectangular member made of a vinyl, having an adhesive carrying area on the back side adjacent the top edge and an indicia-receiving area on the front side. The bookmark is adapted to be attached to a book back page by the adhesive area, flexes over the unread pages, to be positioned between read and unread pages and have the indicia-receiving area on the front facing the reader so that indicia thereon is oriented and positioned to be read.

7 Claims, 1 Drawing Sheet

FIG. 1
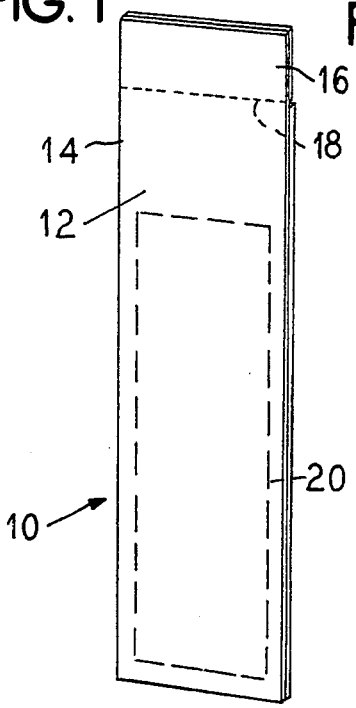
FIG. 2
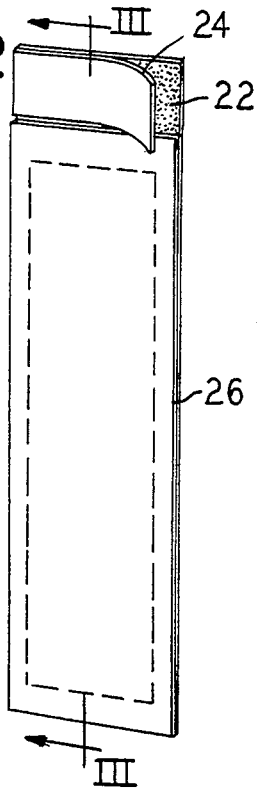
FIG. 3
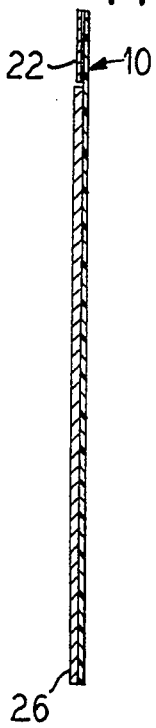
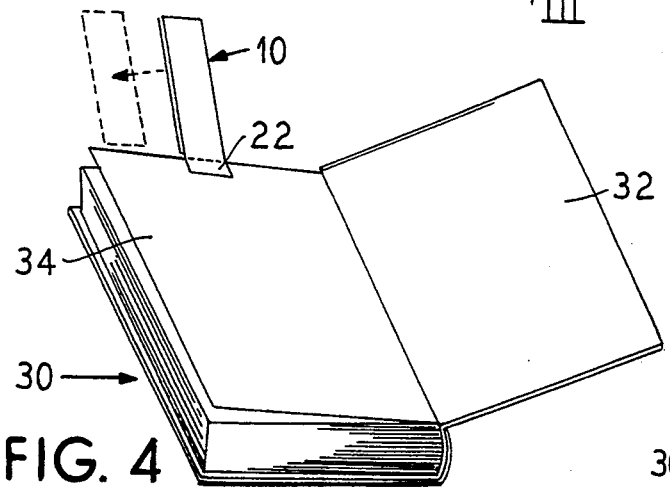
FIG. 4
FIG. 5
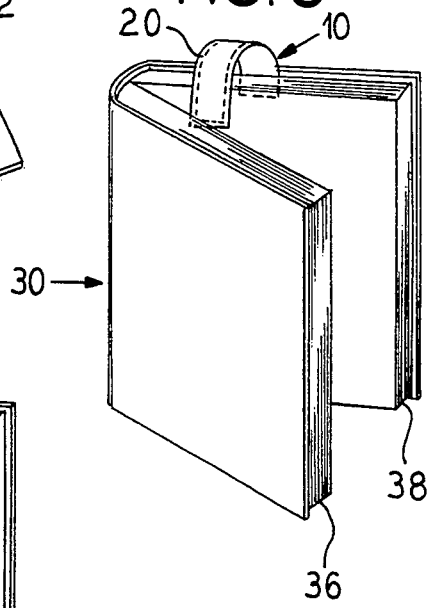
FIG. 6
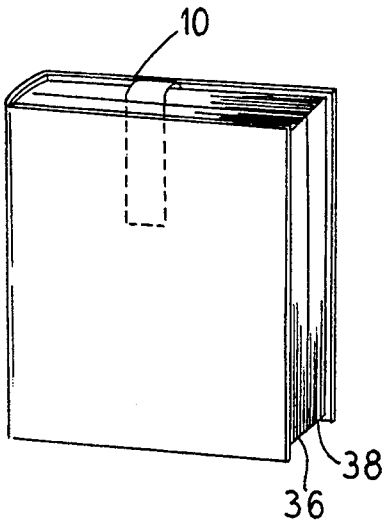

ELASTOMERIC BOOKMARK ASSEMBLY WITH STATIC ELECTRICITY AND ADHESIVE PORTIONS

This is a continuation of application Ser. No. 07/959,608, filed Oct. 13, 1992abandoned.

BACKGROUND OF THE INVENTION

This invention relates to bookmarks, and more particularly, to a bookmark having an adhesive section for attaching to a book and an indicia-receiving section.

Bookmarks are usually simple articles, perhaps a sheet of paper or cardboard, that is placed in a book between read and unread pages so as to indicate where the reader stopped reading or is to begin reading again.

Moreover, bookmarks can sometimes be clips affixed to a page top or a decorated and elongated article that can be inserted between the pages.

However, most of such bookmarks may become lost or separated from the book, which means that the reader will lose its place.

Therefore, it is an object of this invention to provide a bookmark that is attachable to the book and which is unlikely to be separated from the book.

Sometimes the bookmark may be a thin ribbon bound to the binding. However, it is often desirable to make notes while reading and sometimes it is desirable to make these notes on the bookmark. Moreover, bookmarks can be used as an advertising specialty where indicia can be applied to the bookmark for the reader to see. Furthermore, the bookmark should be separate from the book prior use for marking purposes, be attachable after the book is selected and detachable after the book has been read. The bound ribbon does not provide for notes or advertising nor for separate attachment or detachment.

Thus another object of this invention is to provide a bookmark to which an indicia can be applied.

Yet another object is to provide a bookmark which is separate but can be attached or detached from a book.

These and other objects of this invention will become apparent from the following disclosure and appended claims.

SUMMARY OF THE INVENTION

There is provided by the invention hereof a bookmark that is attachable to a book so as not to be lost and which includes an indicia-receiving area on which advertising messages can be imprinted and/or on which reader messages can be written, preferably by ballpoint pen.

More specifically, the bookmark includes an elongated body having an adhesive section at one end of the book for adhering to a book, usually the back page, so as to attach it to the book and prevent it from being lost.

Furthermore, the bookmark is fabricated as a separate member which can be attached and detached from the book.

Moreover, the bookmark is an elongated rectangular member fabricated of a flexible vinyl material which can be flexed from the attachment position to a position marking the extent to which the book has been read.

Another advantage to this system is that the bookmark is fabricated of a material which defines an indicia-receiving area on its face so as to carry advertisements or even reader notes.

Finally, the bookmark is provided with a stiffener/instruction sheet which is adhered to the vinyl member by static electricity, useful during application of the bookmark to the book, and removable.

BRIEF DESCRIPTION OF THE DRAWINGS

FIG. 1 is a plan view of the front of the bookmark of this invention;

FIG. 2 is a plan view of the back or reverse side of a bookmark as in FIG. 1 and showing an adhesive section at the top;

FIG. 3 is a cross-section of the bookmark taken along line III—III of FIG. 2;

FIG. 4 is a perspective view depicting a book opened to a back page with the bookmark attached;

FIG. 5 is a perspective view depicting an upright book with the book being closed and mark in place to mark an unread page; and FIG. 6 is a perspective view of the book in FIG. 5 with the book in the fully closed position.

DESCRIPTION OF THE PREFERRED EMBODIMENT

Referring first to FIG. 1, the bookmark 10 is shown. The mark is an elongated generally rectangular member having a front 12 and a back 14. In general the mark 10 has a top portion 16 which on the front is defined by a scoreline 18 and an indicia-receiving area 20 between the scoreline 18 and bottom edge of the mark.

The mark is flexible and thin and is preferably fabricated of a vinyl.

Referring to FIG. 2, the top of the book mark is provided with an attachment adhesive 22 which is applied to the mark and over which a peelable separation layer 24 is applied. The adhesive 22 can be exposed by peeling off layer 24 so as to expose adhesive 22 so as to permit the mark to be attached to the book or the like.

A paper instruction sheet and stiffener 26 is applied to the remainder of the back of the mark and can be peelably removed so as to expose the underlying vinyl. The sheet 26 adheres to the vinyl body by static electricity. The instruction sheet advises how to attach the bookmark and how to use the same. The sheet also provides body or stiffness to the bookmark during attachment.

Referring to FIG. 4, a book 30 is shown with the back cover 32 opened so as to expose the book page 34. A bookmark such as 10 is shown attached thereto. The adhesive section 22 at the top and back of the mark is shown secured to the book with the body of the mark extending away from the book. Thus the mark is secured to the book and can be bent over or flexed over the unread pages.

As shown in FIG. 5, the book 30 is closed and is in effect separated into the read front section 36 and unread back section 38. The bookmark 10 is attached to the back of the book, is flexed over the unread section 38 and positioned between the read and unread sections 36 and 38 so as to mark the separation between the read and unread sections 36 and 38.

As can be seen, the bookmark 10 when in place and flexed is positioned so that the advertising, etc., in the indicia-receiving area 20 is readable. In other words, the front side is oriented so that advertising material thereon can be read.

Notes can be placed on the bookmark by the reader either on the front 12 or back 14 of the mark 10. A closed book is shown in FIG. 6 where the front or read portion 36 has been closed onto the unread portion 38 so as to trap or position the bookmark 10 therebetween.

Although the invention has been described with respect to a preferred embodiment, changes and modifications can be made which are within the spirit and scope of the invention.

I claim as my invention:

1. A bookmark assembly having a body to be attached to a book and to be flexed and inserted between pages of a book so as to mark a designated place, which assembly includes:

an elongated strip-shaped body having a front, a back, a pair of side edges, a top end and a bottom end, said body fabricated of an elastomeric material which exhibits static electric properties and is flexible, so that said body can be flexed over book pages and be positioned between pages;

an adhesive applied on an area on the back side of the body adjacent one end thereof and extending between said side edges for securement to a book so that said flexible body can be attached to a book;

said back side of said body having a remaining area without adhesive, said remaining area locating from the other end to a side of said adhesive area;

a stiffener member removably secured by static electricity to the back side of the elastomeric body in said remaining area so as to be secured to the body and be removable to expose elastomeric material of said body underlying the stiffener;

wherein the exposed flexible body when adhesively secured to a page of said book by said adhesive area defining a point of attachment thereof, said body is flexed from said point of attachment over book page to another pages of said book to thereby designate the desired pages.

2. The bookmark as in claim 1, wherein the body is rectangularly shaped.

3. The bookmark as in claim 1, wherein a removable cover is provided over the adhesive area so as to expose the adhesive upon removal.

4. The bookmark as in claim 1, wherein the stiffener member also includes instruction indicia thereon.

5. The bookmark as in claim 1, wherein the elastomeric material is a vinyl.

6. The bookmark as in claim 1, wherein the elastomeric body can receive indicia thereon.

7. A bookmark assembly having a body to be attached to a book and to be inserted between pages of a book so as to mark a designated place, which assembly includes:

an elongated, strip-shaped and rectangular body having a front, a back, a pair of side edges, a top and a bottom, said body fabricated of a flexible vinyl material which exhibits static electric properties and is flexible so that said body can be flexed over book pages and be positioned between pages;

an adhesive applied on an area on the back side of the body adjacent the top and extending between the side edges so that said flexible body can be attached to a book;

said back side of said body having a remaining area without adhesive, said remaining area locating from the other end to a side of said adhesive area;

a removable cover over the adhesive area so as to expose the adhesive upon removal for securement to a book so that said flexible body can be attached to a book;

a stiffener member removably secured, by static electricity, to the back side of the vinyl body between the bottom and the adhesive area for securement to the body and for removal to expose the vinyl material underlying the stiffener;

said stiffener including instruction indicia for use of the bookmark;

indicia on the vinyl member on the front side, wherein the exposed flexible vinyl body when adhesively secured to a page of said book by said adhesive area defining point of attachment thereof, said body is flexed from said point over book pages to another page of said book to thereby designate the desired pages.

* * * * *